United States Patent [19]

Meissner

[11] 4,145,234

[45] Mar. 20, 1979

[54] PROCESS FOR PROVIDING ALUMINUM SUBSTRATES WITH LIGHT-ABSORPTIVE SURFACE LAYER

[75] Inventor: Herbert Meissner, Braunau am Inn, Austria

[73] Assignee: Vereinigte Metallwerke Ranshofen-Berndorf Aktiengesellschaft, Braunau am Inn, Austria

[21] Appl. No.: 882,339

[22] Filed: Mar. 1, 1978

[51] Int. Cl.[2] ..... C23F 7/06; C23F 5/02

[52] U.S. Cl. ..... 148/6.27; 204/35 N; 427/160

[58] Field of Search ..... 148/6.2, 6.27, 6.1; 204/35 N, 38 A; 427/160

[56] References Cited

U.S. PATENT DOCUMENTS 1,965,269 7/1934 Tostevud ..... 148/6.27 X

OTHER PUBLICATIONS

Fish lock, Metal Colouring, Robert Draper Ltd., (1962), pp. 350, 351.

*Primary Examiner*—Ralph S. Kendall
*Attorney, Agent, or Firm*—Karl F. Ross

[57] ABSTRACT

To provide a substrate of aluminum with a dark surface layer of high absorption/emission ratio for luminous energy, the degreased and pickled substrate is immersed in a hot chromating bath until an oxide coating of not more than 2.5μ thickness is formed thereon. This coating is then colored black in a hot, acidic dyeing solution (pH between about 0.5 and 5) of potassium permanganate and a nitrate of cobalt or copper.

6 Claims, No Drawings

PROCESS FOR PROVIDING ALUMINUM SUBSTRATES WITH LIGHT-ABSORPTIVE SURFACE LAYER

FIELD OF THE INVENTION

My present invention relates to a process for blackening a substrate of aluminum to facilitate absorption of luminous (especially solar) energy for heating and other industrial purposes.

BACKGROUND OF THE INVENTION

The sun's energy can be utilized in a relatively simple, ecologically beneficial manner by intercepting its rays with the aid of collectors having a light-absorbing surface, the accumulating heat being carried off to a load by suitable means such as a fluid-circulating system. Solar energy is mainly concentrated in the near-infrared and visible ranges of the spectrum having wavelengths of about 0.2 to 2.5$\mu$. An efficient absorber, whose absorption coefficient $\alpha$ approaches unity, must act as a black body for this radiation.

Unfortunately, such black bodies usually are also effective emitters of the same radiant energy, with an emission coefficient $\epsilon$ also approaching unity, i.e. with an absorption/emission ratio $\alpha/\epsilon \approx 1$. In order to reduce the resulting heat loss, this absorption ratio must be significantly increased. Body surfaces with a ratio $\alpha/\epsilon \geqq 1$ are termed selective absorbers; with $\alpha/\epsilon \geqq 5$ they are considered highly selective.

There are various ways in which aluminum can be blackened, including anodizing, chromating and chemical dyeing. With all these conventional techniques, however, the absorption/emission ratio still remains close to 1.

OBJECT OF THE INVENTION

The object of my present invention, therefore, is to provide a process for blackening aluminum substrates in a manner resulting in a high absorption/emission ratio.

SUMMARY OF THE INVENTION

I have found, surprisingly enough, that this object can be attained by forming an oxide coating with a maximum thickness of about 2.5$\mu$ on a surface of the aluminum substrate and dyeing this coating black in a hot acidic aqueous solution of potassium permangate and a nitrate of cobalt and/or copper.

The use of a solution containing potassium permangate facilitates the dyeing of this thin oxide coating whose initial hue ranges from colorless to light gray. The proportion of $KMnO_4$ may vary widely, upwardly of about 1 gram per liter, with about 200 grams per liter representing a practical upper limit. A preferred range is 5 to 30 g/l; above a concentration of 25 g/l I have not observed any noticeable change in absorption rate.

The copper and/or cobalt nitrates may be present in a range between substantially 1 and 100 grams per liter, preferably 5 to 25 g/l.

The pH of the solution may vary between about 0.5 and 5, a preferred range being 2 to 3. The adjustment of the pH can be accomplished by the addition of nitric or acetic acid, for example. The temperature of the solution should be close to the boiling point, advantageously between substantially 90° and 100° C. The treatment time in the solution may range between 1 and 5 minutes.

With the aforestated values I have been able to obtain absorption coefficients $\alpha$ well above 0.8 and absorption/emission ratios in excess of 3.

EXAMPLE I

An aluminum substrate, degreased and briefly pickled, is treated for two minutes in an aqueous bath of 95° C. containing 50 g/l sodium carbonate and 15 g/l sodium chromate. This treatment results in the formation of a light-gray oxide coating of 0.5$\mu$ thickness. The coated substrate, upon thorough rinsing, is dyed in an aqueous solution of 90° C. containing 10 g/l $KMnO_4$ and 20 g/l $Co(NO_3)_2$, with admixture of sufficient nitric acid to produce a pH of 2. After a 5-minute immersion, the oxide coating has turned black with an absorption coefficient $\alpha=0.90$ and a ratio $\alpha/\epsilon=7.4$.

EXAMPLE II

An aluminum substrate, cleansed as in the preceding Example, is oxidized for one minute in a bath of 100° C. containing 45 g/l $Na_2CO_3$ and 15 g/l $Na_2CrO_4$. The subsequent dyeing treatment, after rinsing, is carried out in a solution of 90° C. containing 100 g/l $KMnO_4$, 10 g/l $Co(NO_3)_2$ and 4 ml/l nitric acid. The resulting surface layer has an absorption coefficient $\alpha=0.85$ and a ratio $\alpha/\epsilon=7.4$.

EXAMPLE III

Cleansed and pickled aluminum substrate is oxidized for 5 minutes in a bath of 95° C. containing 55 g/l $Na_2CO_3$ and 20 g/l $Na_2CrO_4$. The resulting oxidized coating, after cleansing, is dyed black in a solution of 90° C. containing 10 g/l $KMnO_4$, 10 g/l $Co(NO_3)_2$ and 4 ml/l acetic acid. The parameters of the resulting surface layer are $\alpha=0.83$ and $\alpha/\epsilon=6.4$.

EXAMPLE IV

Oxidation of an aluminum substrate is carried out in a bath of 95° C. containing 50 g/l $Na_2CO_3$ and 20 g/l $K_2CrO_4$, with formation of an oxide coating of 0.5$\mu$ thickness after one minute. The dyeing solution, maintained at 90° C., contains 50 g/l $KMnO_4$ and 100 g/l $Co(NO_3)_2$, its pH being adjusted to 4.5 by the addition of $HNO_3$. The parameters of the resulting layer are $\alpha=0.92$ and $\alpha/\epsilon=3.5$.

EXAMPLE V

Aluminum substrate, oxidized in the same manner as in the preceding Example, is dyed in a bath of 100° C. containing 10 g/l $KMnO_4$, 15 g/l $Cu(NO_3)_2$ and 4 ml/l $HNO_3$. The parameters are $\alpha=0.88$ and $\epsilon=0.18$, giving a ratio $\alpha/\epsilon=4.9$.

EXAMPLE VI

An aluminum substrate is oxidized in a hot alkaline chromating bath, as described above, until its oxidized layer has a thickness of 2$\mu$. The dyeing solution, at a temperature of 90° C., contains 10 g/l $KMnO_4$ and 100 g/l $Cu(NO_3)_2$ plus enough $HNO_3$ to produce a pH of 1.5. After a treatment of 5 minutes, the parameters are $\alpha=0.9$ and $\alpha/\epsilon=3.2$.

As will be apparent from Examples I - IV, treatment solutions containing 10, 15 or 20 g/l $Co(NO_3)_2$ (representative of the preferred range of 5 to 25 g/l) produce highly selective absorbers whereas acceptable $\alpha/\epsilon$ ratios are still obtainable with concentrations up to 100 g/l. The same, essentially, applies to $Cu(NO_3)_2$ as borne out by Examples V and VI. Proportions of $KMnO_4$ below 25 g/l (Example III) under otherwise similar conditions are slightly less favorable than the higher ones (Example II), though good results are available with concentrations as low as 5 g/l. The aforestated minimum proportion of 1 g/l, both for $KMnO_4$ and the nitrates, still provides absorption/emission ratios well above unity.

I claim:

1. A process for providing a substrate of aluminum with a dark surface layer of high absorption/emission ratio for luminous energy, comprising the steps of immersing said substrate in an oxidizing bath for a period just sufficient to form an oxide coating of not more than about 2.5$\mu$ on a surface thereof, rinsing the surface so coated, and thereafter immersing said substrate in an acidic aqueous solution of potassium permanganate and a nitrate of cobalt or copper, said solution having a pH between substantially 0.5 and 5 and a temperature between substantially 90° and 100° C., the proportion of potassium permanganate in said solution ranging between substantially 1 and 200 grams per liter, the proportion of the nitrate in said solution ranging between substantially 1 and 100 grams per liter.

2. A process as defined in claim 1 wherein the pH ranges between 2 and 3.

3. A process as defined in claim 1 wherein the potassium permanganate is present in said solution in a proportion of at least 5 grams per liter.

4. A process as defined in claim 1 wherein the nitrate is present in said solution in a proportion of 5 to 25 grams per liter.

5. A process as defined in claim 1 wherein said solution contains nitric or acetic acid.

6. A process as defined in claim 1 wherein said oxide coating is formed in a hot alkaline chromating bath to a thickness on the order of 1$\mu$.

* * * * *